United States Patent [19]

Blount et al.

[11] Patent Number: 4,966,233

[45] Date of Patent: Oct. 30, 1990

[54] TRACER DEPLOYMENT TOOLS

[75] Inventors: Curtis G. Blount, Wasilla; Frank E. Bergren, III, Anchorage, both of Ak.

[73] Assignee: Atlantic Richfield Company, Los Angeles, Calif.

[21] Appl. No.: 409,178

[22] Filed: Sep. 19, 1989

[51] Int. Cl.[5] ..... E21B 49/00

[52] U.S. Cl. ..... 166/250; 166/64; 166/66; 166/65.1; 250/303; 250/259; 250/269

[58] Field of Search ..... 166/65.1, 108, 336, 166/337, 317, 383, 384, 385, 386, 387, 146, 252, 162, 259, 260, 258, 269, 337; 250/259, 260, 269, 303, 356.2, 364

[56] References Cited

U.S. PATENT DOCUMENTS

| | | | |
|---|---|---|---|
| 3,493,757 | 2/1970 | Glenn | 250/259 |
| 4,289,200 | 9/1981 | Fisher | 166/182 |
| 4,421,982 | 12/1983 | Potter et al. | 250/260 |
| 4,771,635 | 9/1988 | Trevillion | 73/155 |
| 4,809,778 | 3/1989 | Johnson | 166/162 |

*Primary Examiner*—Jerome W. Massie, IV
*Assistant Examiner*—Roger J. Schoeppel
*Attorney, Agent, or Firm*—Michael E. Martin

[57] ABSTRACT

A tracer deployment tool for discharging a quantity of radioactive or other toxic tracer material into a wellbore for distribution into an earth formation with an injection fluid includes a first piston held in a predetermined position by shear pins and a member supporting a rupturable vial of tracer material. The member connected to the piston is formed as a generally cylindrical cage through which a knife member extends and responds to movement of the cage to rupture the vial. Movement of the piston uncovers passages which permit through-flow of liquid through the vial retaining cage to flush the tracer material thoroughly from the tool. An elongated actuating rod is connectable to a packer setting mechanism or the like for effecting operation of the tool. An alternate embodiment includes two pistons which define the tracer holding chamber. One of the pistons is connected to the actuating rod and is movable relative to the second piston to reduce the volume of the chamber, displace the second piston to uncover discharge port means and effect discharge of the tracer material from the tool.

22 Claims, 3 Drawing Sheets

TRACER DEPLOYMENT TOOLS

BACKGROUND OF THE INVENTION

1. Field of the Invention

The present invention pertains to a tool for deploying or injecting tracer materials into an earth formation through a wellbore, particularly radioactive or other highly toxic type tracer materials.

2. Background

In the development and production of hydrocarbon reservoirs, certain fluid injection processes are studied with respect to the distribution of fluid flow by mixing with the distributed fluid a tracer material which is highly radioactive. When dispersed through the reservoir the radioactivity concentration is reduced, but during the injection process the concentration in the small amount of tracer material used in the process is relatively high and the handling of this material presents several problems in regard to tools and related equipment associated with the deployment process.

In utilizing radioactive tracer materials for injection into subterranean reservoirs, usually only relatively short half-life radioactive materials at relatively low concentrations are injected in isolated areas downhole adjacent to the injection zone to be studied. Radioactive tracer materials which have relatively long half-lives or are of relatively strong concentrations and are to be injected in relatively large quantities are usually pumped with injection fluids into the wellbore from the surface. The surface injection procedure will not permit, typically, zonal isolation of the injected tracer material. However, there are many instances wherein it is desired to inject relatively high energy and long half-life type tracer materials into specific zones within a well. Moreover, known types of tools for deploying short half-life type radioactive tracer materials in wellbores have some shortcomings. Existing types of tools are not easily adapted to minimize their size for shipment from the tracer material loading source to the well site and the requirements for approved shipping containers are difficult to accommodate.

Furthermore, conventional tracer deployment tools are not well suited for loading the highly radioactive, long half-life type radioactive tracer material into the tool in the field or at the well site. The residual amounts of tracer material left in conventional tools requires that the tools be disposed of in a suitable manner and the transport and disposal process is complicated by the size of existing tools. Still further, conventional tools are not easily rinsed free of tracer material upon completion of the injection process, thus requiring that the entire tool be disposed of after only one use. The cost of known types of tools therefore makes the use of radioactive tracer materials, in many instances, prohibitive. Accordingly, there has been a need for the development of wellbore tracer material deployment tools which have advantages or features which overcome the deficiencies of prior art tools including those mentioned herein.

SUMMARY OF THE INVENTION

The present invention pertains to improved deployment or injection tools particularly adapted for transporting a quantity of a radioactive tracer material into a wellbore, deploying the tracer material into a fluid stream for injection into an earth formation and retrieval of the tool for disposal or reuse.

In accordance with one aspect of the present invention a radioactive tracer deployment tool is provided which is adapted to be easily loaded at the well site with a vial or container of radioactive tracer material and, upon actuation of the tool, rupture the container to deploy the material in he wellbore whereby the material may be mixed with an injection fluid stream and injected directly into the desired subterranean formation. The tool does not require preloading of a loose quantity of tracer material but is adapted to receive and subsequently rupture a container of material, which container may be easily transported from its manufacturing or loading site, full of tracer material, to the wellbore site and then loaded into the tool.

In accordance with another important aspect of the present invention, a tracer deployment tool is provided which has improved fluid flushing characteristics which permit thorough flushing or rinsing of the tool to remove tracer material therefrom, thereby minimizing the amount of tracer material remaining in the tool and brought back to the surface with the tool. Tools are provided which are adapted to minimize disposal problems and which may be reused either partially or completely.

The present invention still further provides an improved tracer deployment tool which may be run into and out of a wellbore on a coiled tubing string, on a wireline cable, or on a conventional tubing string, and tools are also provided which are adapted to be actuated by conventional wellbore actuating mechanisms such as wellbore packer setting tools. The present invention also provides tracer deployment tools which are relatively easy to fabricate, assemble and disassemble and have a tracer material container or vial placed therein.

Those skilled in the art will recognize the above-described advantages and superior features of the present invention together with other important aspects thereof upon reading the detailed description which follows in conjunction with the drawing.

DESCRIPTION OF PREFERRED EMBODIMENTS

Figure 1:
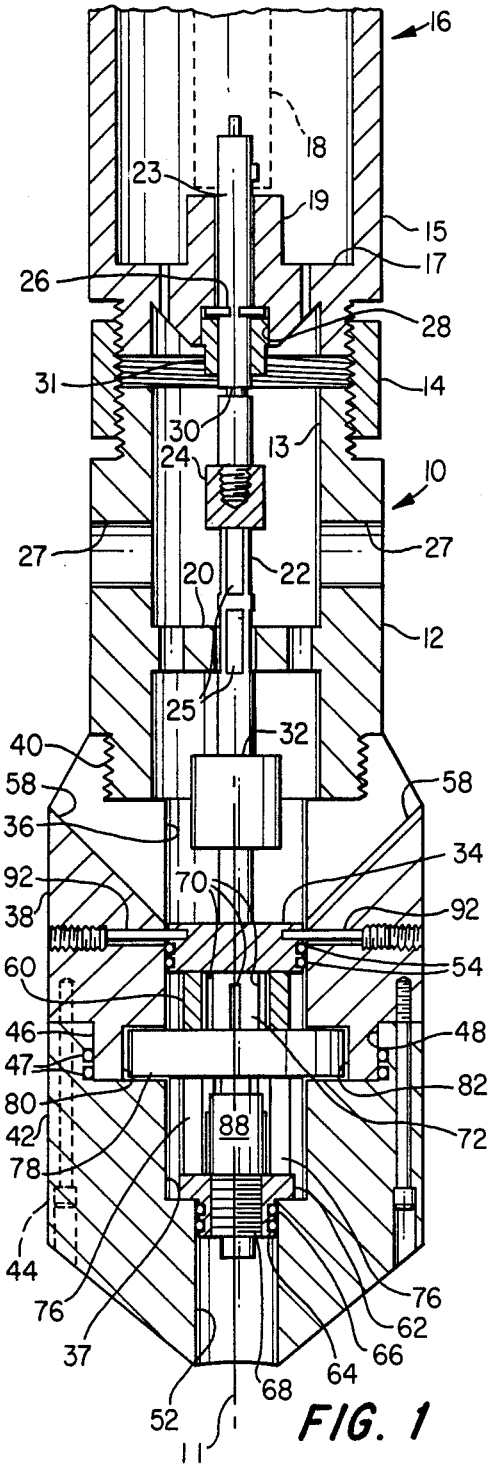
FIG. 1 is a longitudinal central section view of a tracer deployment, tool in accordance with the present invention shown in the preactuated condition.

In the description which follows, like parts are marked throughout the specification and drawing with the same reference numerals, respectively. The drawing figures are not necessarily to scale and certain features of the invention may be shown in schematic or somewhat simplified form in the interest of clarity and conciseness.

Referring to FIG. 1, there is illustrated a central longitudinal section view of a tracer ejector or deployment tool in accordance with the present invention and generally designated by the numeral 10. The tool 10 includes a first generally cylindrical body member 12 having a threaded upper end portion 13 adapted to be suitably connected to an adapter sleeve 14 for connecting the tool to a longitudinally movable sleeve 15 of an actuating device generally designated by the numeral 16. The sleeve 14 is threadedly connected to the body member 12 and to the sleeve 15 of the actuating device 16. Suitable locking setscrews, not shown may be provided on the adaptor sleeve 14 to prevent unwanted movement relative to the members 12 and 15. The actuating device 16 may comprise a packer setting tool, such as a model E-4 made by Baker Packers Division of Baker Hughes Corporation, Houston, Texas. The device 16 is of a type known in the art which is operable from a remote location by way of an electrical transmission cable or wireline to effect longitudinal movement of the sleeve 15 relative to a plunger 18 and mechanism connected thereto and which will be described in conjunction with the tool 10. The device 16 is not a part of the present invention per se and, being a commercially available device, does not require further description herein. Other devices which provide for linear movement of a member such as the sleeve 15 relative to a member such as the plunger 18 may be adapted to be used in conjunction with the tool 10.

The first body member 12 also includes a transverse bulkhead 20 which journals an elongated actuator shaft 22 having a transverse collar portion 24 formed thereon. The shaft 22 includes a section 23 which is threadedly connected to the collar 24, extends through a boss 19, forming part of an end wall 17 of the sleeve 16, and is connected to the plunger 18 at its distal end. A split retaining ring 26 is disposed in a counterbore 28 formed in the boss 19 and is operable to come into registration with a transverse groove 30 formed in the shaft section 23. A removable plug 31 retains the ring 26 in the bore 28. The shaft 22 extends through the bulkhead 20 and may include a second collar portion 32 formed thereon for limiting axial travel of the shaft 22 in the direction coincident with a longitudinal central axis 11 of the tool 10. Wrench flats 25 are formed on the shaft 22 and are accessible for engagement by a suitable wrench, not shown, through access ports 27 whereby the shaft 22 and the body member 14 may be decoupled from the device 16.

The end of the shaft 22 opposite the section 23 is connected to a piston 34. The piston 34 is disposed in a bore 36 formed in a second generally cylindrical body member 38. The body member 38 is suitably connected to the body member 12 such as by a threaded connection at 40 and is larger in diameter than the body member 12. The body member 38 is also suitably connected to a third, generally cylindrical body member 42 such as by a plurality of axially extending threaded fasteners 44. A reduced diameter pilot portion 46 of the body member 38 extends axially into a cooperating counterbore 48 formed in the body member 42 and suitable resilient O-ring type seals are disposed on one of the pilot portion 46 or in the counterbore 48, as shown, to form a seal with respect to the bore 36. A cooperating bore portion 37 formed in the third body member 42 is aligned with and forms part of the bore 36. A reduced diameter bore 52 extends from the bore 37 to the lower end of the body member 42.

The piston 34 is slidably disposed in the bore 36 and is in sealing engagement with the bore wall by cooperating piston rings 54 which may be conventional O-ring seals or the like. At least two opposed slots or channels 58 open from the exterior of the body member 38 into the bore 36 to permit flow of fluid from the exterior of the tool 10 into the bore. Such fluid flow may extend through the bores 36 and 52 when piston 34 is moved to the position shown in FIG. 2.

The piston 34 is suitably connected to an elongated hollow cylindrical cage member 60 which extends within the bore 36 and is connected at its lower end to a closure head 62 having a reduced diameter part 64 which is journaled in the bore 52 and is in sealing engagement with the bore wall by one or more suitable O-ring type seals 66 disposed on the head part 64. A cylindrical plug 68 is disposed in the head part 64 and may be removed therefrom. The plug 68 may be threadedly engaged with a cooperating bore formed in the head part 64. In the condition of the tool 10 shown in Figure the portion of the bore 36 between the piston 34 and the closure head 62 is closed to provide a fluid tight chamber.

Figure 3:
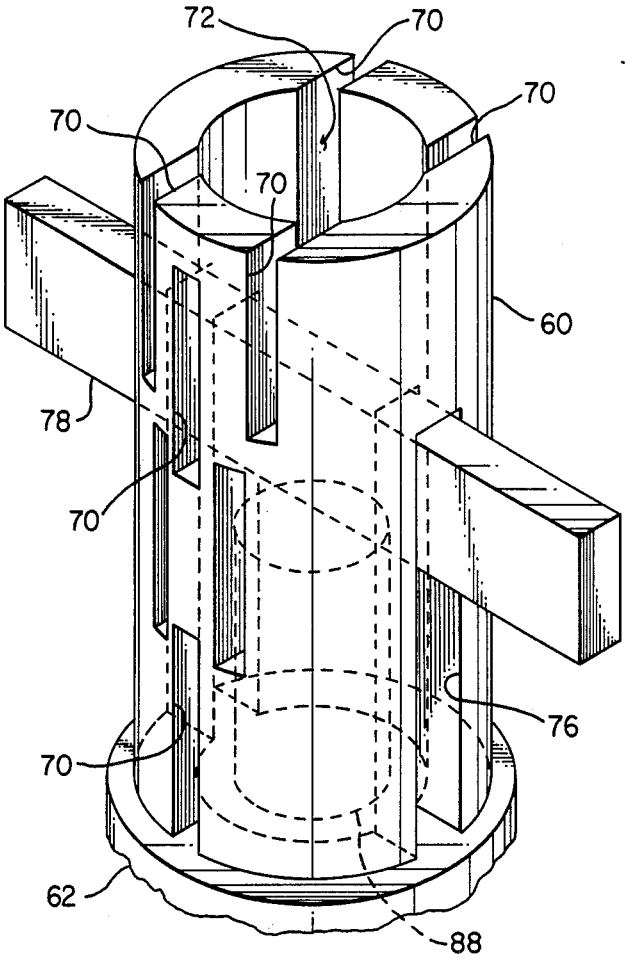
FIG. 3 is a perspective view of part of the tracer vial rupture mechanism.

The cage member 60 includes a plurality of elongated slots 70 formed therein and opening into an interior chamber 72, see FIG. 3 also. The chamber 72 extends through the cage member 60 and is, accordingly, in communication with the chamber formed by the bore 36. As shown in FIG. 3, the cage member 60 is also provided with two opposed axially extending slots 76 which extend part way the axial length of the cage member 60 and are adapted to receive a transversely extending knife member 78.

Referring again to FIG. 1, the knife member 78 is retained in opposed slots 80, 82 formed in the second body member 38 and opening into the bore 36. The knife member 78 is thus restrained by the body members 38 and 42 when they are assembled together and prevented from longitudinal and transverse movement with respect to the body members 38 and 42. The cage member 60 is adapted to support a frangible vial or similar container 88 of a tracer material between the knife 78 and the plug 68. Accordingly, the vial 88 may be disposed in the chamber 72 by removing the plug 68 from the cylinder head part 64, inserting the vial therein and replacing the plug 68, all without disassembling the tool 10. The vial 88 may be of a type which is easily adapted for shipment to the site where the tool 10 is to be used by conventional and approved shipping means.

Figure 2:
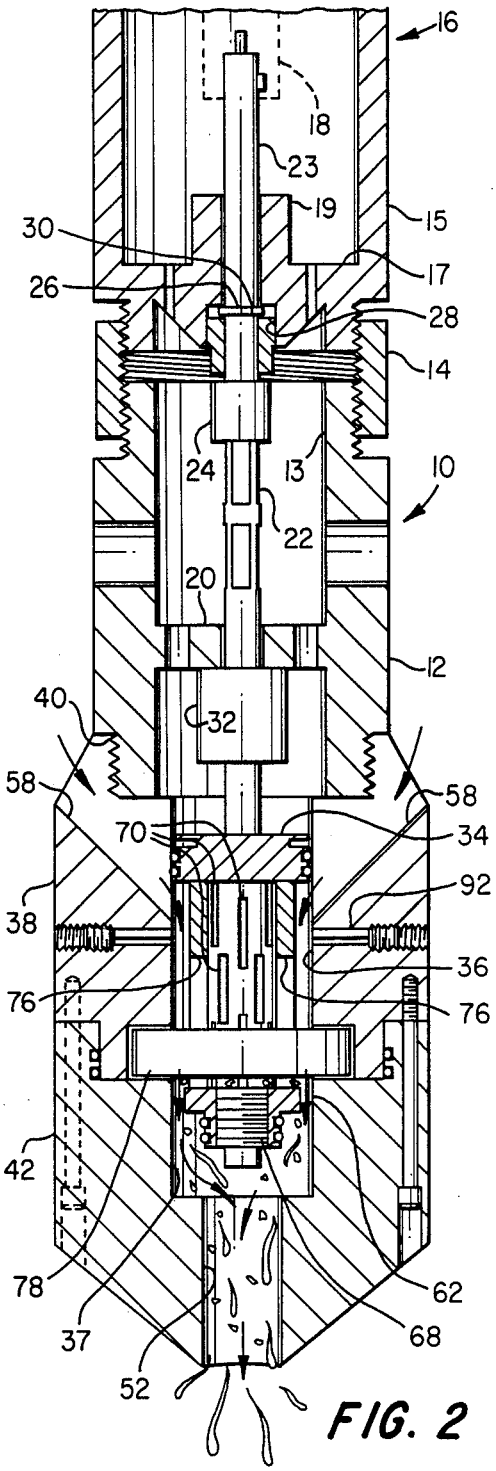
FIG. 2 is a central section view of the tool of FIG. 1 after actuation to rupture the tracer material container or vial.

The piston 34, together with the cage 60, is retained in the position illustrated in FIG. 1 by frangible means comprising opposed shear pins 92 which are supported on the body member 38 and extend into the bore 36 and into cooperating bores formed in the piston. In response to a sufficient force operating to effect relative longitudinal movement between the body member 12 and the actuator rod 22 by the setting device 16, the pins 92 are sheared and the piston 34, together with the cage 60 and the vial 88, are moved relative to the knife 78, and with sufficient force to rupture the vial to release the radioactive tracer material into the chamber formed by the bore 36. FIG. 2 illustrates the condition of the tool 10 wherein the rod 22 has been actuated by the device 16 to shear the pins 92 and crush the vial 88 containing the tracer material, releasing the material for flow through the bores 36 and 52 to the exterior of the tool. Upon movement of the piston 34 and the cage 60, as described, the head part 64 is removed from sealing engagement with the bore 52 to open a flow path for fluid to flow through the passages 58 and the bores 36 and 52 to the exterior of the tool. The slots 70 and 76 formed in the cage member 60 permit a thorough flushing action of the fluid flowing through the tool 10 to remove all of the tracer material from the chamber 72 and the chambers formed by the bores 36 and 52. As the rod 22 moves with respect to the retaining ring 26 the groove 30 will eventually move into registration with the retaining ring allowing it to snap into the groove and prevent reclosure of the tool or returning of the rod 22 to the position illustrated in FIG. 1. Movement of the rod 22 may also be limited by engagement of the collar 32 with the bulkhead 20.

The operation of the tool 10 is believed to be clearly understandable to those of ordinary skill in the art of tracer deployment or ejector tools from the foregoing description. The tool 10 may be run into a wellbore on a wireline cable or on coiled tubing, including the type wherein a wireline cable is extended through the coiled tubing employing an arrangement generally of the type described in U.S. Pat. No. 4,685,516 assigned to the assignee of the present invention.

Briefly, upon placement of a vial 88 of tracer material in the chamber 72 and closure of the chamber by insertion of the plug 68, with the actuator rod 22 in the position illustrated in FIG. 1, the tool 10 may be deployed into a wellbore connected to the actuating device 16 which in turn is connected to a standard electric logging cable or "wireline". Alternatively, the tool may be run on a coiled tubing string having a wireline cable extending therethrough as described in the aforementioned patent.

By remote control the device 16 may be operated to effect movement of the sleeve 16 and the assembly of the body members 12, 38 and 42 relative to the rod 22, viewing FIGS. 1 and 2, while essentially simultaneously a fluid is injected into the wellbore at least in the vicinity of the tool 10 and in the wellbore annulus formed by the tool. Upon movement of the piston 34 past the edge of the bore 36 at which the passages 58 intersect the bore and movement of the cage 60 relative to the knife 68, the vial 88 is ruptured to release the tracer material into the bore 36 whereby, substantially simultaneously, fluid may flow through the passages 58 and the bores 36 and 52 to thoroughly flush the tracer material into the wellbore below the tool for injection into an earth formation.

Thanks to the arrangement of the body members 38 and 42 and the cage 60, the injection fluid which carries the tracer material into the formation thoroughly flushes the tool proper whereby upon retrieval of the tool 10 to the surface, and suitable testing for the presence of contaminating material, the tool 10 or at least portions thereof may be reused. In any case, possibly only certain portions of the tool such as the piston 34, cage 60 and the housing members 38 and 42 may require disposal. Since only this portion of the tool requires disposal, the size of the portion of the tool requiring disposal is reduced. As mentioned before when the sleeve 15 and the tool body move to the position shown in FIG. 2 relative to the rod 22, the retaining ring 26 moves into registration with the groove 30 thereby preventing reclosure of the passages formed within the housings 38 and 42 and trapping tracer material therein.

The tool 10 enjoys other advantages with respect to minimizing the accidental discharge of tracer material. For example, in the event that the vial 88 should rupture accidentally, the piston 34 and the head portion 64 are provided with double O-ring type seals to aid in containing the tracer material within the chamber formed by the bore 36 between the piston 34 and the head portion 64. Moreover, double O-ring seals 47 are provided at the joint between the second and third housing portions 38 and 42. Thanks also to the shear pins 92, which project into cooperating bores formed in the piston 34, the accidental movement of the piston 34 and cage 60 is also minimized. Still further, accidental firing of the actuating device 16, if such should occur, would not result in forcible ejection of the tracer material from the tool 10 since the action of the tool does not impart acceleration to the tracer material from the chamber formed by the bore 36.

Figure 4:
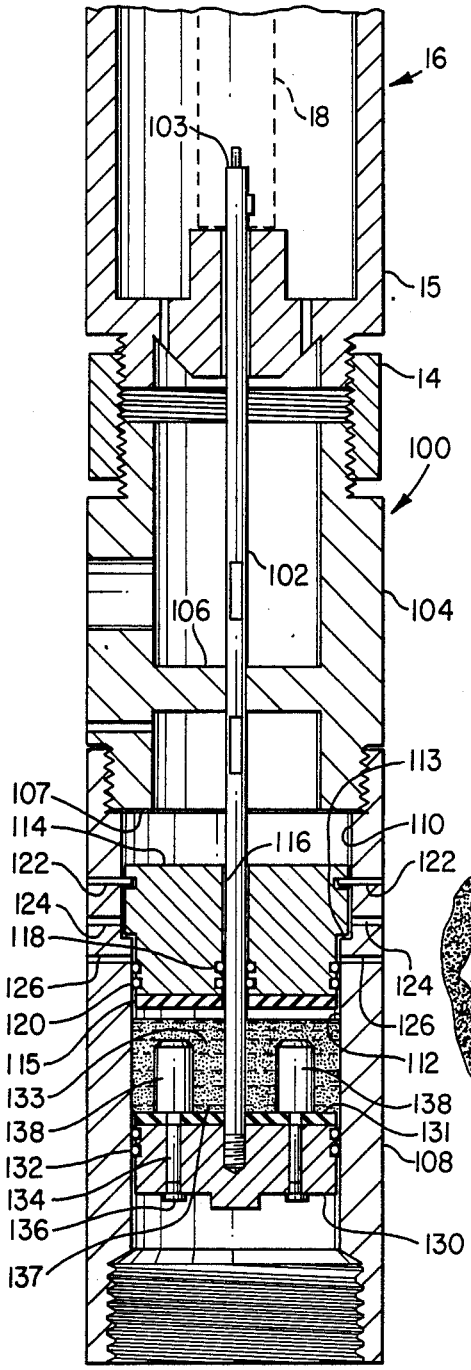
FIG. 4 is a central longitudinal section view of an alternate embodiment of a tracer deployment tool of the present invention.
Figure 5:
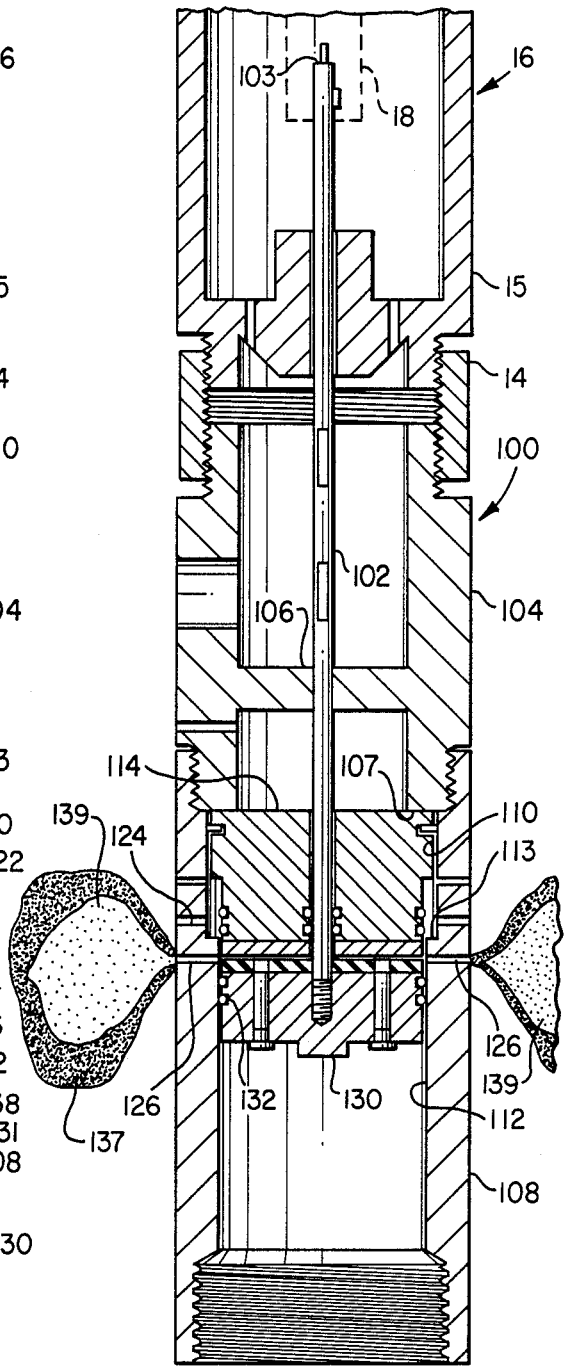
FIG. 5 is a view similar to FIG. 4 showing the tool in the actuated condition.

Referring now to FIGS. 4 and 5, an alternate embodiment of a tracer deployment tool in accordance with the present invention is illustrated and generally designated by the numeral 100. The tool 100 is adapted to be connected to the actuating device 16, including the sleeve 15 and plunger 18, the latter of which is connected to an elongated actuating rod 102 at its distal end 103. The actuating rod 102 extends within a first body member 104 formed as a generally cylindrical part and having a transverse bulkhead 106 disposed therein through which the rod 102 extends. The body member 104 is interconnected with the actuating device 16 by a sleeve 14 in a manner similar to the arrangement of the tool 10. The body member 104 is suitably connected to a second body member 108 having internal, coaxial and interconnected cylindrical bore portions 110 and 112, the latter being slightly smaller than the former. A stepped first piston or movable wall part 114 is disposed in the bore portions 110 and 112 and is provided with a central bore 116 through which the actuating rod 102 extends and is in sealing engagement with double O-ring seals 118 supported on the piston 114. Double O-ring seals 120 are also supported on the piston 114 and are in sealing and sliding engagement with the bore wall forming the bore 112. A pair of opposed shear pins 122 are supported by the body member 108 and project into cooperating grooves formed in the piston 114 to retain the piston in the position illustrated in FIG. 4. Opposed vent ports 124 open from the exterior of the body member 108 into the bore 110 and opposed tracer fluid discharge ports 126 open from the exterior of the body member 108 into the bore 112 at a point between the 0-ring seals 120 and a shoulder in the body part 108 formed between the bores 110 and 112.

The tool 100 includes a second piston 130 disposed in the bore 112 and connected to the actuating rod 102. The piston 130 includes double 0-ring seals 132 supported thereon and in sliding engagement with the bore wall forming the bore 112. As shown in FIG. 4, a chamber 133 is formed between the pistons 114 and 130 in the position of the pistons relative to each other as illustrated in FIG. 4. Opposed faces of the pistons 114 and 130 are provided With elastomeric facings 115 and 131, respectively. The chamber 133 is preferably at least partially filled with a dense liquid 137 by way of one or more closable fill ports 134 having removable plugs 136 formed thereon. The chamber 133 is also adapted to receive one or more frangible vials or containers 138 filled with tracer material such as a radioactive fluid.

The tool 100 may be interposed in a tubing string or suspended from a wireline or a coiled tubing string and inserted in a wellbore into the vicinity of the perforations or wellbore zone into which the tracer material is to be injected. Upon actuation of the actuating device 16 the sleeve 15 and body members 104 and 108 move relative to the rod 102 toward the position shown in FIG. 5 wherein the piston 130 initially moves to reduce the volume of the chamber 133 which effects rupture of the vials 138 releasing the tracer fluid within the quantity of dense liquid filling the chamber 132. As the relative motion of the actuating rod 102 continues, the hydraulic pressure acting across the facing 115 of piston 114 increases to a point which will effect shearing of the pins 122 and movement of the piston 114 into engagement with a transverse shoulder 107 formed on the body member 104.

As the piston 114 moves to the position shown in FIG. 5, the ports 126 are placed in communication with the chamber 133 and continued movement of the piston 130 toward the piston 114 forcibly discharges the tracer material 139 and dense liquid 137 through the ports into the wellbore whereby fluid injected into the wellbore annulus from the surface, for example, carries the tracer material into an earth formation for distribution therethrough. The dense liquid 137 substantially encapsulates the lower density tracer fluid 139, particularly, while these fluids are still in the chamber 133. Since the volume of the chamber 133 is reduced to nil in the position of the tool parts illustrated in FIG. 5, by engagement of the facings 115 and 131 with each other and the tracer fluid is ejected in a substantially encapsulated state, essentially all of the tracer material is ejected from the tool.

The operation of the tool 100 is also believed to be readily understandable from the foregoing description and from the illustrations of FIGS. 4 and 5 of the drawing. The tool 100 enjoys certain advantages of the tool 10 with respect to provisions for initial placement of a closed container of tracer material within the tool to minimize the chance of spillage of this material and to facilitate loading and delivery of the radioactive tracer material to the work site in an approved and easily transportable container. The chamber 133 is sealed by double O-ring seals 120 and 132 on the respective pistons 114 and 130. Still further, the discharge ports 136 are suitably retained closed and out of communication with the chamber 133 due to the fact that the piston 114 is pinned in a position which closes these ports from communication with the chamber until the tool is actuated. Moreover, the provision of the more dense fluid 137 surrounding the vials 138 minimizes contamination of the tool 100 upon rupture of the vials. Conventional engineering materials for wellbore tools handling radioactive materials may be used in fabricating the tools 10 and 100.

Although preferred embodiments of a tracer deployment or ejection tool for use in connection with distributing tracer materials into earth formations from a wellbore have been described hereinabove, those skilled in the art will recognize that various substitutions and modifications may be made to the particular tools disclosed without departing from the scope and spirit of the invention as recited in the appended claims.

What is claimed is:

1. A tool for discharging a quantity of tracer material into a wellbore, said tool comprising:

body means including a body member defining a generally cylindrical bore;

an actuating device connected to said body means;

a piston disposed in said bore and connected to said actuating device for movement from a first position to a second position, said piston forming a first closure member at substantially one end of said bore;

a member connected to said piston and disposed in said bore for supporting a container of tracer material in said bore;

passage means formed in said body member and operable to communicate said bore with the exterior of said tool in response to movement of said piston from said first position to said second position;

a head part closing an opposite end of said bore in said first position of said piston and movable with said piston to open said opposite end of said bore to the exterior of said tool whereby in response to movement of said piston from said first position to said second position, said bore is opened to provide for the through-flow of wellbore fluid through said bore; and means cooperable with said member connected to said piston and operable in response to movement of said piston for rupturing said container to discharge tracer material into said bore and out of said tool with wellbore fluid flow through said bore between said one end and said opposite end.

2. The tool set forth in claim 1 wherein:

said passage means comprises opposed channel means in said body means and opening from the exterior of said tool to said bore for conducting fluid to said chamber upon movement of said piston toward said second position.

3. The tool set forth in claim 1 wherein:

said member connected to said piston comprises a generally cylindrical cage having a hollow interior for receiving said container, and said means for engagement with said container comprises a generally transversely extending knife member supported by said body means and extending through slot means formed in said cage for engaging said container in response to movement of said cage and said container relative to said body means and said knife means.

4. The tool set forth in claim 3 wherein:

said cage includes opening means formed therein for communicating fluid flowing through said bore with an interior chamber of said cage for flushing tracer material from said chamber and said bore to the exterior of said tool.

5. The tool set forth in claim 4 including:

a removable plug at one end of said chamber for placing said container within said chamber.

6. The tool set forth in claim 5 wherein:

said plug is supported on said head part and is accessible from the exterior of said tool through said passage means.

7. The tool set forth in claim 1 including:

frangible means supported on said tool and engaged with said piston for retaining said piston in said first position.

8. The tool set forth in claim 7 wherein:

said frangible means comprises shear pin means adapted to shear in response to an actuating force exerted on said piston by said actuating device.

9. The tool set forth in claim 1 including:

seal means operable to seal said bore from communication with the exterior of said tool in said first position of said piston.

10. The tool set forth in claim 1 wherein:

said actuating device includes an elongated actuating rod connected to said piston, and said actuating rod includes stop means for limiting the movement of said actuating rod and said piston to said second position.

11. The tool set forth in claim 1 including:

means cooperable with said actuating rod for holding said actuating rod and said piston in said second position in response to movement of said actuating rod from said first position to said second position.

12. A tool for discharging a quantity of tracer material into a wellbore, said tool comprising:

a body member including means for connecting said tool to an actuating device;

actuating rod means adapted to be connected to said actuating device and movable with respect to said body member;

said body member including a generally cylindrical bore and port means in said body member opening from said bore to the exterior of said tool;

a first piston disposed in said bore and, in a first position, closing said port means;

a second piston connected to said rod means and defining with said first piston and said body member a chamber for holding a quantity of tracer material;

means for retaining said first piston in said first position; and said tool being responsive to movement of said second piston to reduce the volume of said chamber to provide movement of said first piston to a second position whereby in response to movement of said second piston toward said first piston under the urging of said rod means, said first piston is moved to uncover said port means to discharge tracer material from said chamber through said port means to the exterior of said tool.

13. The tool set forth in claim 12 wherein:

said means for retaining comprises shear pin means supported on said body member and engaged with said first piston for retaining said first piston in a position to close said port means from communicating with said chamber.

14. The tool set forth in claim 12 including:

stop means on said body member for engaging said first piston to define said second position of said first piston whereby said second piston may move to engage said first piston and reduce the volume of said chamber.

15. The tool set forth in claim 14 wherein:

said first piston and said second piston include elastomeric facing means cooperable to reduce the volume of said chamber to nil.

16. The tool set forth in claim 12 wherein:

said first piston and said second piston each include seal ring means cooperating with said body member to form a substantially fluid tight seal for said chamber.

17. The tool set forth in claim 12 in combination with:

a container disposed within said chamber and holding a quantity of tracer material, said container being frangible upon movement of said first piston toward said second piston to release said tracer material into said chamber.

18. The tool set forth in claim 17 in combination with:

a quantity of dense liquid disposed in said chamber and encapsulating said container, said liquid being ejectable from said chamber for transporting said tracer material from said tool.

19. In combination with a tool for discharging a quantity of tracer material into a wellbore, said tool comprising a body member including means for connecting said tool to an actuating device, actuating rod means adapted to be connected to said actuating device and movable with respect to said body member, said body member including a generally cylindrical bore defining a chamber, and port means in said body member opening from said bore to the exterior of said tool, and a first piston disposed in said bore and, in a first position, closing said port means;

a quantity of tracer material disposed in said chamber, and a quantity of liquid encapsulating said tracer material, said liquid being ejectable from said chamber for transporting said tracer material from said tool;

said tool being responsive to movement of said first piston to uncover said port means to permit discharge of tracer material and said liquid from said chamber through said port means to the exterior of said tool.

20. The combination set forth in claim 19 wherein:

said tool includes a second piston connected to said rod means and defining with said first piston and said body member said chamber, said combination includes a frangible container for said tracer material in said chamber; and said tool is responsive to movement of said second piston toward said first piston to reduce the volume of said chamber and rupture said container to release said tracer material into said liquid.

21. The tool set forth in claim 20 wherein:

the density of said liquid is greater than the density of said tracer material.

22. A tool for discharging a quantity of tracer material into a wellbore, said tool comprising:

body means including a body member defining a generally cylindrical bore;

a piston disposed in said bore and movable from a first position to a second position, said piston forming a first closure member at substantially one end of said bore;

means disposed in said bore for supporting a container of tracer material in said bore;

passage means formed in said body member and operable to communicate said bore with the exterior of said tool in response to movement of said piston from said first position to said second position;

a part closing an opposite end of said bore in said first position of said piston and movable with said piston to open said opposite end of said bore to the exterior of said tool whereby in response to movement of said piston from said first position to said second position, said bore is opened to provide for the through-flow or wellbore fluid through said bore; and means cooperable with said means for supporting said container operable in response to movement of said piston for rupturing said container to discharge tracer material into said bore and out of said tool with wellbore fluid flow through said bore between said one end and said opposite end.

* * * * *